United States Patent [19]

Kakalec

[11] 4,030,025

[45] June 14, 1977

[54] FERRORESONANT REGULATOR WITH SUPPLEMENTARY REGULATION THROUGH WAVEFORM CONTROL

[75] Inventor: Robert John Kakalec, Madison, N.J.

[73] Assignee: Bell Telephone Laboratories, Incorporated, Murray Hill, N.J.

[22] Filed: Feb. 20, 1976

[21] Appl. No.: 659,696

[52] U.S. Cl. ..... 323/61; 321/25; 323/86

[51] Int. Cl.[2] ..... G05F 1/64

[58] Field of Search ..... 307/235 A; 321/16, 18, 321/25; 323/6, 45, 60, 61, 62, 86; 328/151, 170, 175; 334/56, 71

[56] References Cited

UNITED STATES PATENTS

| | | | |
|---|---|---|---|
| 2,753,512 | 7/1956 | Helterline et al. | 323/45 |
| 3,046,466 | 7/1962 | Tyrrell et al. | 321/16 |
| 3,155,894 | 11/1964 | Bell | 323/60 X |
| 3,209,239 | 9/1965 | D'Agostino | 323/45 |
| 3,247,450 | 4/1966 | Medlar | 323/60 |
| 3,281,723 | 10/1966 | Mercer | 328/175 X |
| 3,414,826 | 12/1968 | Vandegraaf | 334/71 X |
| 3,566,148 | 2/1971 | Wood | 307/235 A |
| 3,679,966 | 7/1972 | Wanlass | 323/60 X |
| 3,931,576 | 1/1976 | Csicsatka | 328/175 X |
| R27,916 | 2/1974 | Kakalec | 323/60 X |

FOREIGN PATENTS OR APPLICATIONS

| | | | |
|---|---|---|---|
| 1,945,403 | 1/1971 | Germany | 323/61 |
| 1,932,628 | 1/1971 | Germany | 323/61 |
| 46-20979 | 6/1971 | Japan | 323/61 |

*Primary Examiner*—A. D. Pellinen
*Attorney, Agent, or Firm*—Alfred G. Steinmetz

[57] ABSTRACT

A ferroresonant voltage regulator utilizes control of the voltage peak of a signal waveform as a voltage regulation technique. The peak of the voltage waveform is adjusted in response to a feedback control. The regulated output voltage is derived from a peak voltage detector.

8 Claims, 3 Drawing Figures

FERRORESONANT REGULATOR WITH SUPPLEMENTARY REGULATION THROUGH WAVEFORM CONTROL

BACKGROUND OF THE INVENTION

2. Field of the Invention

This invention relates to voltage regulators and in particular to ferroresonant type voltage regulators. It is specifically concerned with a voltage regulation technique utilizing voltage waveform control.

2. Prior Art

Prior art regulator circuits regulate voltage by controlling the average value of a transmitted waveform or by controlling the volt seconds integral of a transmitted waveform. Conventional series type and switching type voltage regulators operate by controlling the average value of the transmitted voltage waveform. A series type regulator inserts a variable impedance between the source and the load to control the average value. A switching type regulator pulse width modulates the voltage signal transmitted to the load in order to control the average value.

Ferroresonant type voltage regulators, in contrast to averaging, conventionally regulate the output voltage by controlling the volt seconds integral of a transmitted voltage waveform. A source voltage waveform is applied to a saturating transformer which saturates it at a predetermined volt seconds integral of the applied voltage waveform. The output waveform is limited to the volt seconds integral determined by the saturation of the transformer. This volt seconds limited waveform is then rectified to produce a regulated DC voltage signal.

The ferroresonant regulator has the advantages of being efficient, simple, and reliable. Its major disadvantage is that the output voltage varies directly with the frequency of the input signal to the ferroresonant transformer and, hence, precise regulation is dependent upon the maintenance of the precise frequency of an input signal. This frequency sensitivity problem has been substantially overcome with the development of the feedback controlled ferroresonant voltage regulator which uses an electronic switching device to bring about simulated saturation in the transformer core. This feedback controlled ferroresonant regulator operates to simulate a saturating core when a particular volt seconds value of a waveform has been transmitted through the transformer. This feedback controlled ferroresonant regulator has the capability to regulate for frequency changes.

A typical regulator of this type is disclosed in patent No. RE. 27,916, issued to R. J. Kakalec on Feb. 12, 1974, and entitled "Closed Loop Ferroresonant Voltage Regulator Which Simulates Core Saturation." The feedback controlled ferroresonant regulator, however, in terms of concept of operation, is still a volt seconds integral type voltage regulator as is the conventional ferroresonant regulator.

SUMMARY OF THE INVENTION

It is an object of this invention to achieve voltage regulation by waveform control.

It is another object of the invention to control the peak level of a transmitted voltage waveform to regulate a voltage.

It is yet another object of the invention to apply waveform control to achieve ferroresonant type regulation.

Therefore, in accord with the invention, a ferroresonant transformer voltage regulator is designed to include electronic controls to provide supplementary voltage regulation by waveform control. This added electronic control circuitry includes an inductor having a controllable quality connected in series with the ferrocapacitor of the ferroresonant transformer for the purpose of adjusting the peak of the waveform. A variable impedance connected in parallel with the inductor is controlled to vary the quality of the inductor in response to a voltage monitor which monitors the rectified and filtered output voltage of the ferroresonant transformer voltage regulator. By varying the quality of the inductor the peak magnitude of the voltage across the secondary winding of the transformer is controlled. This voltage waveform with the controlled peak is full-wave rectified and applied to a peak voltage detector. A regulated output voltage is derived from the voltage output of the peak voltage detector. This particular circuit provides a new form of regulation by controlling the peak of the waveform as opposed to controlling its volt seconds integral or its average value.

DETAILED DESCRIPTION

Figure 1:
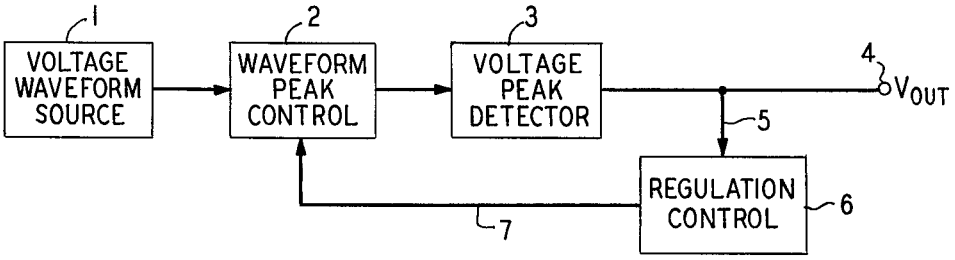
FIG. 1 is a block diagram of a voltage regulation system to illustrate the principles of the invention.

A ferroresonant regulator disclosed in FIG. 1 utilizes voltage waveform control in order to regulate a voltage. This is to be distinguished from the volt seconds integral control of the conventional ferroresonant regulator. The essential elements as disclosed in block diagram are a source of voltage waveforms 1, a waveform peak control circuit 2, and a voltage peak detector 3, all of which are connected in series. A regulated output voltage at terminal 4 is derived from the voltage peak detector 3.

A source of voltage waveforms 1 generates voltage waveforms which can have an average value which is different from their peak values. A waveform peak control 2 adjusts the maximum peak value that the waveform attains during each half cycle. The waveform peak control 2 is responsive to a regulation control 6 which monitors the output voltage through a sensing lead 5. A regulation control 6 performs a comparison function with a reference voltage and applies a control signal, via lead 7, to cause the waveform peak control 2 to change the peak of the voltage applied thereto in order to maintain a regulated output voltage. The peak of the voltage output of the waveform peak control 2 is applied to a voltage peak detector 3 from which a regulated output voltage at terminal 4 is derived.

The waveform peak control 2 may comprise an inductor connected in series with the ferrocapacitor of a ferroresonant transformer and further includes circuitry to vary the quality of the inductance in response to the regulation control 6. Generally, in accord with the principles of the invention, the quality of the inductor is varied by shunting it with a variable impedance which is responsive to the regulation control circuit 6. The value of the inductance is selected to be resonant with the ferrocapacitor at some higher harmonic frequency of the voltage waveform source. By varying this shunt impedance, shunting the inductor the quality of the inductor is controllably altered thereby changing the resonant response of the inductor. This change in the quality of the inductor permits positive control of the peaks of the applied waveform. Since the peak voltage is applied to a peak voltage detector from which the output voltage is derived, the output voltage is accurately regulated by accurately controlling the peak of the voltage waveform.

Figure 2:
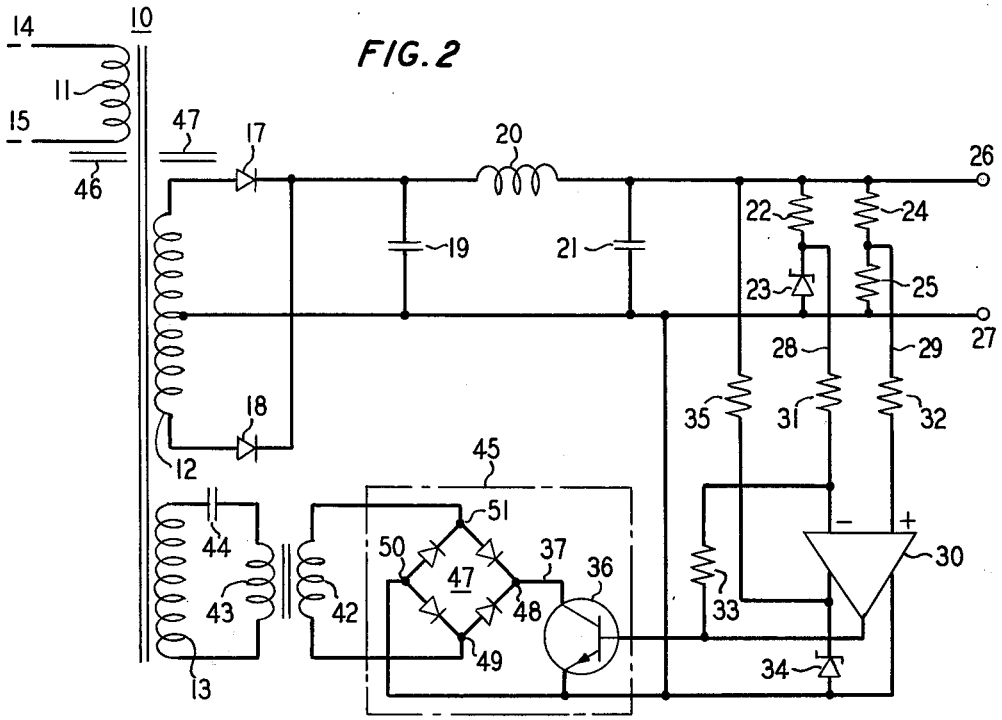
FIG. 2 is a partial block and schematic diagram of a ferroresonant regulator having a feedback control to regulate the voltage output which embodies the principles of the invention.

A more detailed schematic illustrating the application of the principles of the invention to a ferroresonant regulator is shown in FIG. 2. The ferroresonant regulator includes a ferroresonant transformer 10 which comprises a primary winding 11, a secondary winding 12, and a control winding 13. The input signal is applied to input terminals 14 and 15. The input signal may comprise any periodic waveform. The transformed waveform appearing across output winding 12 is rectified by rectifying diodes 17 and 18 connected in a full wave rectifying configuration and applied to the peak voltage detecting capacitor 19. The peak voltage detected by capacitor 19 is transmitted via a low-pass filter comprising the inductor 20 and capacitor 21 to the output terminals 26 and 27 or the regulator to which a load may be attached.

The input winding 11 is separated from the output winding 12 and the control winding 13 via the magnetic shunts 46 and 47. The transformer 10 is designed so that the portion of the core common to the output winding 12 and the control winding 13 goes slightly into saturation during each half cycle of operation.

The output voltage across terminals 26 and 27 is monitored by an operational amplifier 30. A voltage divider comprising resistor 22 and a voltage breakdown diode 23 is shunted across the output terminals 26 and 27 to derive a reference voltage which is applied, via lead 28 and resistor 31, to the inverting input of the operational amplifier 30. A second voltage divider comprising resistors 24 and 25 is shunted across the output terminals to derive a voltage which is a function of the output voltage. This voltage is coupled, via lead 29 and resistor 32, to the noninverting input of operational amplifier 30. The output voltage of the operational amplifier 30 is a function of the deviation of the output voltage at terminals 26 and 27 from its regulated value.

An energizing circuit including resistor 35 and voltage breakdown diode 34 is connected to the output of the LC filter and derives therefrom a controlled voltage to energize the operational amplifier 30. A feedback resistor 33 provides negative feedback to control gain. Compensating circuitry may be added to stabilize the phase gain of the feedback circuit. The nature of such circuitry is well known to those skilled in the art and hence is not disclosed herein.

The control winding 13 of the transformer 10 is shunted by a ferrocapacitor 44 and an inductor 43 connected in series. The inductor 43 includes a secondary winding 42 which is shunted by a quality control network 45 responsive to the output of the operational amplifier 30. The quality control network 45 controls the quality of the inductor 43 in response to the output voltage of the operational amplifier 30.

The quality of an inductor, sometimes referred to as its Q-value is a measure of its electrical response in a tuned circuit at or near a resonant frequency. This electrical response is measured by the voltage peak magnitude across the tuned circuit and the bandwidth of this response. In practical circuit terms the quality of an inductor is a measure of the effective resistance of the inductor which in turn is a measure of the energy dissipation in the inductor.

In the ferroresonant regulator herein the impedance of the inductor 43 is controlled through the secondary winding 42 by the quality control circuit 45. The inductance of the inductor 43 is selected so that it resonates with the ferrocapacitor 44 at a frequency higher than the frequency of the input signal applied to input terminals 14 and 15. In the present embodiment the inductor 43 is selected to be resonant with the ferrocapacitor 44 at the third harmonic of the input signal. It is to be understood that regulation may be accomplished by having the tuned circuit resonant at the fifth, seventh, and higher harmonics.

The quality control circuit 45 includes a full wave rectifier 47 and a transistor 36. The inductor's secondary winding 42 is connected to the nodes 49 and 51 of the four diode bridge rectifier 47. The collector-emitter path of the transistor 36 is connectwd across the nodes 48 and 50 of the four diode bridge rectifier 47. This circuit arrangement couples a variable impedance to control the quality of the inductor 43.

The output of the operational amplifier 30 is connected to the base electrode of the transistor 36. The operational amplifier 30 operates as a linear amplifier whose output signal is directly responsive to a deviation of the magnitude of the output voltage at terminals 26 and 27 from its regulated value. This output signal controls the impedance across the collector-emitter path of transistor 36 which in turn directly controls the quality of the inductor 43 in order to regulate the output voltage.

Figure 3:
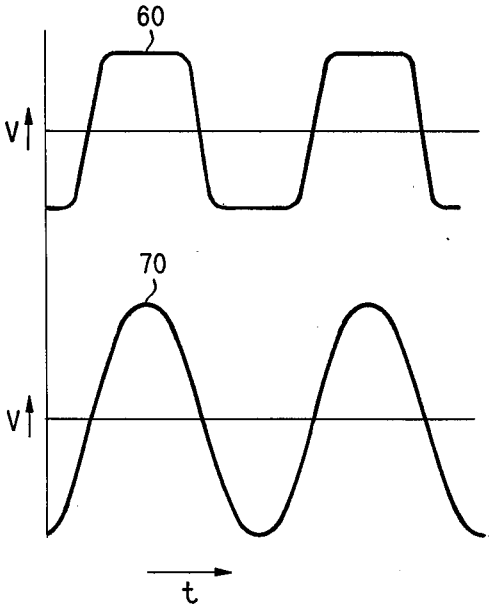
FIG. 3 discloses voltage waveforms to illustrate various modes of operation of the ferroresonant regulator disclosed in FIG. 2.

A description of the response of the circuit to output voltage deviations of the regulator is instructive in explaining the principles of the invention. For example, if the output voltage across terminals 26 and 27 increases in magnitude, the voltage on lead 29 similarly increases. The output of the operational amplifier 30, in response to this increased signal magnitude applied to its noninverting input, produces an increased output signal which drives the NPN transistor 36 further into its conducting region. This reduces the effective impedance across the winding 42 and hence reduces the quality of the inductor 43 connected in series with the ferrocapacitor 44. This decreases the peaking of the voltage across the tuned circuit of the inductor 43 and the ferrocapacitor 44. Hence the voltage across the winding 13 and also across winding 12 has its peak value reduced. This reduces the peak voltage applied to the peak voltage detecting capacitor 19. In response to the reduced peak voltage the output voltage at terminals 26 and 27 is reduced to the desired regulated value. The voltage waveform having a reduced peak value to lower the output voltage is shown by waveform 60 in FIG. 3 which represents the waveform appearing across winding 12.

If, on the other hand, the output voltage goes down below its regulated value, the voltage on lead 29 is also decreased and the output of operational amplifier 30 decreases. This decreased signal operates to increase the resistance across the collector-emitter path of transistor 36. In extreme cases where the output voltage drops significantly, the transistor 36 is cut off. With transistor 36 now at a high impedance level or nonconducting, the quality of the inductor 43 is close to or at its maximum value. The peak of the voltage across the tuned circuit of the inductor 43 and the ferrocapacitor 44 is increased. This results in a waveform across windings 12 and 13 which is more peaked, such as shown by waveform 70 in FIG. 3. This highly peaked waveform applies a greater peak voltage to the peak voltage detecting capacitor 19 which in turn increases the output voltage at terminals 26 and 27 to restore it to its regulated value.

The value of the inductance to be selected for inductor 43 is dependent upon the particular characteristics and voltage range to be controlled by the regulator. In general it has been found, as described above, that an inductor 43 whose inductance is resonant with the ferrocapacitor 44 at the third harmonic of the fundamental frequency of the ferroresonant regulator is a suitable value for effective voltage regulation. However, it may be selected in certain instances to resonate at higher harmonics.

The ferroresonant regulator circuit shown in FIG. 2 has been shown in generalized schematic form and it will be apparent to those skilled in the art that various compensation networks may be added to the feedback network to achieve certain particular regulation characteristics. However, these are techniques well known in the art and it is not believed necessary to disclosed them in detail herein.

While the above invention has been described specifically with reference to a ferroresonant regulator it will be apparent to those skilled in the art that the technique of voltage waveform control by peaking in combination with regulation feedback control may be applied to many various types of regulation circuits without departing from the spirit and scope of the invention.

I claim:

1. A voltage regulator comprising:

a ferroresonant transformer including a primary winding to accept an AC signal, a secondary winding and a ferroresonant capacitor, output circuitry including a peak voltage detector coupled to said secondary winding, a linear inductive device coupled in series with said ferroresonant capacitor, the resonant frequency of said inductive device and said ferroresonant capacitor being greater than the resonant frequency of said secondary winding and said ferroresonant capacitor, voltage monitoring circuitry to monitor a voltage of said output circuitry, and a linearly variable impedance shunting said linear inductive device and responsive to said voltage monitoring circuitry whereby a voltage peak of a signal of the secondary winding of said ferroresonant transformer is modified in response to said voltage monitoring circuit.

2. A signal regulator for deriving a regulated voltage from a signal having a waveform whose peak value differs from its average value, comprising:

means for adjusting the peak value of the waveform of the signal including a ferroresonant transformer having an output winding and a tertiary winding, a ferrocapacitor and linear inductor connected in series circuit, the series circuit shunting said tertiary winding, a peak waveform detector coupled to said output winding, means for monitoring a voltage output of said peak waveform detector including means for generating an error signal responsive to a deviation of the voltage output of said peak waveform detector from a regulated value, and said means for adjusting the peak value including means for continuously adjusting the quality of said linear inductor, including a continuously variable impedance coupled in parallel with said linear inductor and an impedance of said variable impedance being responsive to said error signal.

3. A signal regulator as defined in claim 2 wherein an inductance of said ferroresonant transformer and said ferrocapacitor is resonant at a first frequency, and said ferrocapacitor and linear inductor connected in series circuit is series resonant at a harmonic of said first frequency.

4. A voltage regulator comprising:

a ferroresonant transformer including an input winding and an output winding, a ferroresonant capacitor and a linear inductor connected in series and coupled to said output winding, a peak voltage detector coupled to said output winding, means for monitoring an output voltage of said peak voltage detector including means for generating an error signal respresentative of a deviation of the output voltage from a regulated value, means for linearly varying the quality of said linear inductor in response to said means for monitoring including a linearly variable impedance coupled in shunt with said linear inductor, an impedance of said variable impedance being responsive to said error signal.

5. A voltage regulator as defined in claim 4 wherein an inductance of said ferroresonant transformer and said ferrocapacitor are tuned resonant at a first frequency, and said ferroresonant capacitor and linear inductor connected in series are tuned series resonant at a harmonic of said first frequency.

6. A voltage regulator as defined in claim 4 wherein:

said peak voltage detector comprises a capacitive device, and said variable impedance comprises a transistor whose conduction is responsive to said error signal.

7. A ferroresonant regulator type power supply including:

at least an output winding, and a ferroresonant capacitor coupled to said output winding, a linear inductor connected in series with said ferroresonant capacitor a peak voltage detector coupled to said output winding, means for monitoring an output voltage of said peak voltage detector, means responsive to said means for monitoring for varying the quality of said linear inductor including a linearly variable impedance coupled in parallel with said inductor, and said variable impedance responsive to an output of said means for monitoring whereby the quality of said linear inductor is varied to control the peak amplitude of a signal across said output winding.

8. A ferroresonant regulator as defined in claim 7 wherein:

said means for varying the quality further comprises a quality control winding magnetically coupled to said linear inductor, a bridge rectifier having two opposite nodes coupled to opposite ends of said quality control winding, said linearly variable impedance comprising a transistor having its collector-emitter path coupled to nodes of said bridge adjacent said opposite nodes, said means for monitoring including a voltage comparator, and the output of said comparator being coupled to a base electrode of said transistor.

* * * * *